US007677929B2

(12) United States Patent
Bradford-Stagg

(10) Patent No.: US 7,677,929 B2
(45) Date of Patent: Mar. 16, 2010

(54) SACRIFICIAL LAPTOP COMPUTER POWER CONNECTOR

(76) Inventor: Daphne Bradford-Stagg, 968 Keta Cres., Virginia Beach, VA (US) 23451

( * ) Notice: Subject to any disclaimer, the term of this patent is extended or adjusted under 35 U.S.C. 154(b) by 87 days.

(21) Appl. No.: 12/156,754

(22) Filed: Jun. 4, 2008

(65) Prior Publication Data

US 2009/0305577 A1 Dec. 10, 2009

(51) Int. Cl.
*H01R 13/00* (2006.01)

(52) U.S. Cl. ..... 439/638; 439/675; 439/562

(58) Field of Classification Search ..... 439/638, 439/562, 675

See application file for complete search history.

(56) References Cited

U.S. PATENT DOCUMENTS 5,074,809 A * 12/1991 Rousseau ..... 439/675
5,695,365 A * 12/1997 Kennedy et al. ..... 439/638
6,106,333 A * 8/2000 Purdy ..... 439/578
6,174,206 B1 * 1/2001 Yentile et al. ..... 439/638
6,276,970 B1 * 8/2001 Wong ..... 439/638
6,899,563 B1 * 5/2005 Lee ..... 439/578
7,217,163 B2 * 5/2007 Landgraf ..... 439/669
7,384,304 B1 * 6/2008 Fawcett ..... 439/567
7,527,500 B2 * 5/2009 Montena ..... 439/8
2006/0258209 A1 * 11/2006 Hall ..... 439/578
2007/0004276 A1 * 1/2007 Stein ..... 439/578

* cited by examiner

*Primary Examiner*—Gary F. Paumen
(74) *Attorney, Agent, or Firm*—Goldizen & Associates; Bradley D. Goldizen

(57) ABSTRACT

A sacrificial power connector engages a power receptacle on a laptop computer. The connector includes a first end that mates with the power receptacle and a second end that receives a plug from a power cord. A tab includes adhesive that maintains the connector in engagement with the power receptacle of the laptop computer. In this manner, the sacrificial power connector wears out and prevents damage to the power receptacle on the laptop computer. The sacrificial connector allows a broken path of electrical current to be reestablished.

13 Claims, 8 Drawing Sheets

SACRIFICIAL LAPTOP COMPUTER POWER CONNECTOR

There are no related patent applications.

This application did not receive any federal research and/or development funding.

TECHNICAL FIELD

Generally the invention relates to a power cord/connector device for supplying power to a laptop computer that has failed. More specifically, the device is a sacrificial laptop power cord, connector, or combination thereof that includes a connector end having a plug arranged thereat and a receptacle opposite the plug. The plug end of the sacrificial laptop power connector is inserted into the power receptacle of the power supply card for the laptop computer and may include a region that is weakened to cause an increase in the overall diameter of the plug when it is inserted into the computer. The opposite side of the power cord/connector device either receives a plug from a power supply cord that supplies power to the laptop computer or is coupled to the power residential or commercial power source. In one embodiment, the sacrificial connector can be left attached to the laptop computer when the power supply cord is disengaged from the laptop computer to prevent failure of the power receptacle of the power supply card. The sacrificial laptop power connector includes an attachment region that aids in fastening the connector to an exterior surface of the case of the laptop computer to assist in stabilizing the portion of the connector that extends into the power receptacle of the laptop power supply.

BACKGROUND OF THE INVENTION

Laptop computers are portable computers that are easily transported. Many laptop computers include a power supply cord that includes an adaptor that converts alternating current (AC) to direct current (DC). In many countries, such as the United States, 120 volts AC is provided by a power company to homes and offices. In these countries, the power supply cord includes two flat prongs and a possibly separate ground prong. The prongs are inserted into a 120 VAC wall mounted receptacle. In European Countries, wall mounted receptacles typically provide 240 VAC and include two cylindrical prongs and a separate ground connection.

The laptop power supply cord includes a first end that inserts into an AC outlet to provide voltage to a voltage regulator or adaptor that converts AC to DC voltage. A second end of the power supply cord includes a co-axial plug that typically includes a central cylindrical extension or pin surrounded by a barrel. The central cylindrical extension or pin is biased at a DC voltage while the barrel is connected to ground. In this manner, a user cannot ordinarily come into contact with the DC voltage and power flows from the AC wall outlet to be converted into DC and routed into the computer for recharging on board batteries or operating the computer.

A circular opening is provided in a case of the laptop computer for inserting the second end of the power supply cord into the laptop computer. A power supply board within the laptop computer includes a power receptacle having an opening that is arranged to receive co-axial plug of the second end of the power supply cord. This co-axial plug extends into the computer case. The laptop power receptacle includes at least one grounding prong, typically a plurality of grounding prongs, that contacts the metallic exterior surface of the barrel of the co-axial plug to establish a path for current to flow from the central cylindrical extension or pin. The central cylindrical extension pin is seated in a receptacle on the power supply board when the co-axial plug is inserted through the opening in the case. DC voltage is provided through the central cylindrical extension for charging batteries of the laptop computer and for operating the computer.

Over time, problems arise with the laptop power receptacle. The laptop power receptacle is very fragile and eventually the ground portion of the receptacle flattens out or fails to properly ground the laptop to the power source. The power receptacle may be damaged by the continued insertion and disengagement of the co-axial end of the power supply cord. The grounding element(s) that engages the barrel of the plug may become bent or worn such that it fails to create a proper connection when the laptop end of the power supply cord is seated in the power receptacle of the laptop computer. Likewise, the receptacle that receives the power pin arranged within the plug may become bent and inoperable. Otherwise, either the ground or power receptacle on the power supply board may become loose or disengaged. Any of these conditions prevents the laptop computer from receiving power eventually rendering the laptop computer inoperable once the batteries discharge.

The user must transport the laptop computer to a repair shop or have it mailed to the manufacturer and encounter costly repairs and which in many instances causes more damage because the laptop power supply board is attached directly to the mother board. Often it takes weeks for the repair and return of the laptop. In many instances, the cost of repairing the laptop computer may exceed the price of a new laptop computer. Thus, many users discard the broken laptop computer. Since many dangerous chemicals are used in the production of the laptop computer, the computer cannot be simply thrown away. Moreover, discarding the laptop in a haphazard manner may result in identity theft should the user fail to remove sensitive data from the hard drive of the laptop.

It is clear that the insertion of the power connector plug into the on-board power receptacle of a laptop computer causes great wear on the connector causing the power receptacle to prematurely wear out over time. This premature wearing out of the power receptacle results in an inefficient use of resources and causes problems associated with the disposal of the laptop computer. Moreover, proper disposal of a damaged laptop computer raises significant problems that must be overcome. Thus, there is a need to provide a sacrificial laptop computer power connector having an end that is inserted into the laptop power connector and remains there until such time as the sacrificial connector wears out. The worn out sacrificial connector is disengaged from the laptop computer power receptacle and simply disposed by dropping it off at a recycling center. It is estimated that this type of problem is the cause of approximately fifty percent of all laptop repairs.

SUMMARY OF THE INVENTION

The present invention is a sacrificial laptop computer power connector that engages the power connector of the laptop and remains engaged for extended periods of time. The power cord mates with an opposite end of the sacrificial laptop computer power connector and the power cord is disengaged there from. In this manner, the sacrificial laptop computer power connector or the power supply cord wears out. Either of these can be easily repaired or replaced for a mere fraction of the cost of repairing the laptop computer. This creates a cost effective solution since either can be purchased and used by the consumer without a repair shop.

In a first embodiment of the invention, the sacrificial laptop computer power connector includes two ends. A first end includes a plug that is inserted into a power receptacle of a laptop computer. The plug includes a barrel having a pin coaxially arranged within the barrel. The barrel provides a grounding point between the power cord and the laptop computer. In one instance, the barrel may comprise a circular end and having sides that includes openings defined by metallic strips of material which are formed to crumple when the barrel is inserted into the power receptacle of the laptop computer. The pin arranged within the barrel provides a voltage to the laptop computer. The second end of the plug includes a receptacle that receives a plug end of power cord. A thin tab of insulation, such as plastic, is arranged on the exterior of the sacrificial laptop computer power connector and extends radially outward from the sacrificial laptop computer power connector. An adhesive is arranged on the side of the thin tab of insulation nearest the first end. An overlay is provided on the adhesive and removed prior to inserting the first end into the power receptacle of the laptop computer. The adhesive engages the exterior casing of the laptop computer to secure the sacrificial laptop computer power connector in place when the power cord is disengaged from the second end of the sacrificial laptop computer power connector.

In a second embodiment of the invention, the sacrificial laptop computer power connector includes two ends. A first end includes a plug that is inserted into a power receptacle of a laptop computer. The plug includes a barrel having a pin coaxially arranged within the barrel. As in the first embodiment, the barrel may be solid or include openings that are defined by metallic strips that terminate in a circular end. As previously mentioned, the barrel provides a ground between the power cord and the laptop computer. The pin provides a voltage to the laptop computer. The second end includes a receptacle that receives a plug end of power cord. A length of power cord is arranged between the second end and the first end. A thin tab of insulation, such as plastic, is arranged on the exterior of the sacrificial laptop computer power connector and extends radially outward from the sacrificial laptop computer power connector. An adhesive is arranged on the side of the thin tab of insulation nearest the first end. An overlay is provided on the adhesive and removed prior to inserting the first end into the power receptacle of the laptop computer. The adhesive engages the exterior casing of the laptop computer to secure the sacrificial laptop computer power connector in place when the power cord is disengaged from the second end of the sacrificial laptop computer power connector.

It is an object of the invention to provide a cost effective device that extends the operational life of a power receptacle on a laptop computer by providing a sacrificial connector having an end that is inserted into the power receptacle and is left in place until the second end sacrificial power connector or the plug end of the power cord wears out. In this manner, the sacrificial power connector or the power cord wears out without damage or wear occurring to the laptop power receptacle.

It is another object of the invention to provide a device that results in a more efficient use of resources. The device reduces the costs associated with operating a laptop computer while providing a solution to a common problem associated with a worn out or damaged power receptacle of a laptop computer.

It is a further object of the invention to teach a device that extends the operational life of a laptop computer by reducing or preventing the operational wear associated with the repetitious insertion and removal of a laptop power connector into and from an on-board power receptacle. The instant invention reduces the possibility of identity theft caused by improper disposal of hard drive of laptop computer.

It is an additional object of the invention to provide a device that alleviates the recycling concerns associated with disposal of a laptop computer having a damaged power receptacle.

It is a further object of the invention to teach a sacrificial device that when worn out or damaged is cheaper to fix than a damaged power receptacle of a laptop computer. Since the device comprises ordinary metals, it can be easily recycled.

It is an additional object of the invention to provide a sacrificial connector that extends the life of a laptop computer.

It is a further object of the invention to provide a sacrificial power connector that becomes worn out and prevents damage to power supply connector on laptop computer The above and further objects, details and advantages of the invention will become apparent from the following detailed description, when read in conjunction with the accompanying drawings.

DETAILED DESCRIPTION OF THE INVENTION

Figure 1A:
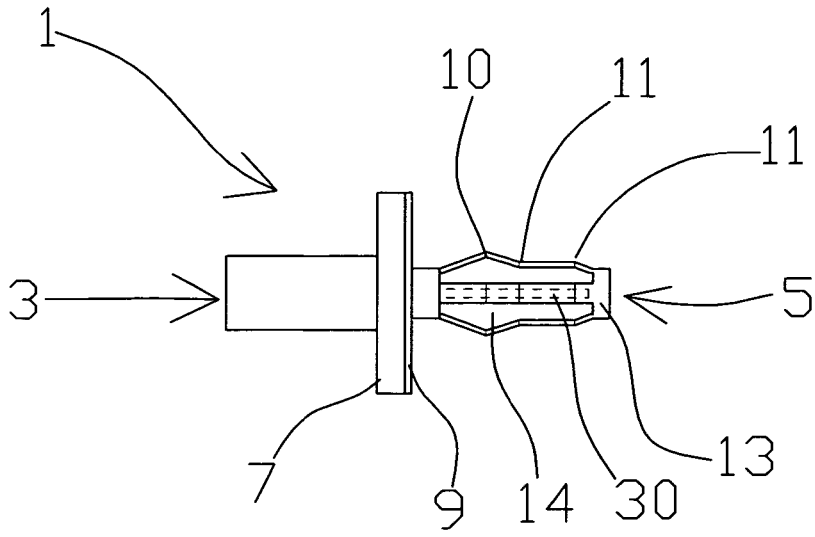
FIG. 1A is an enlarged perspective view of a first embodiment of a sacrificial laptop computer power connector taken from the side and showing the openings that are defined by the metallic strips.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

Figure 5:
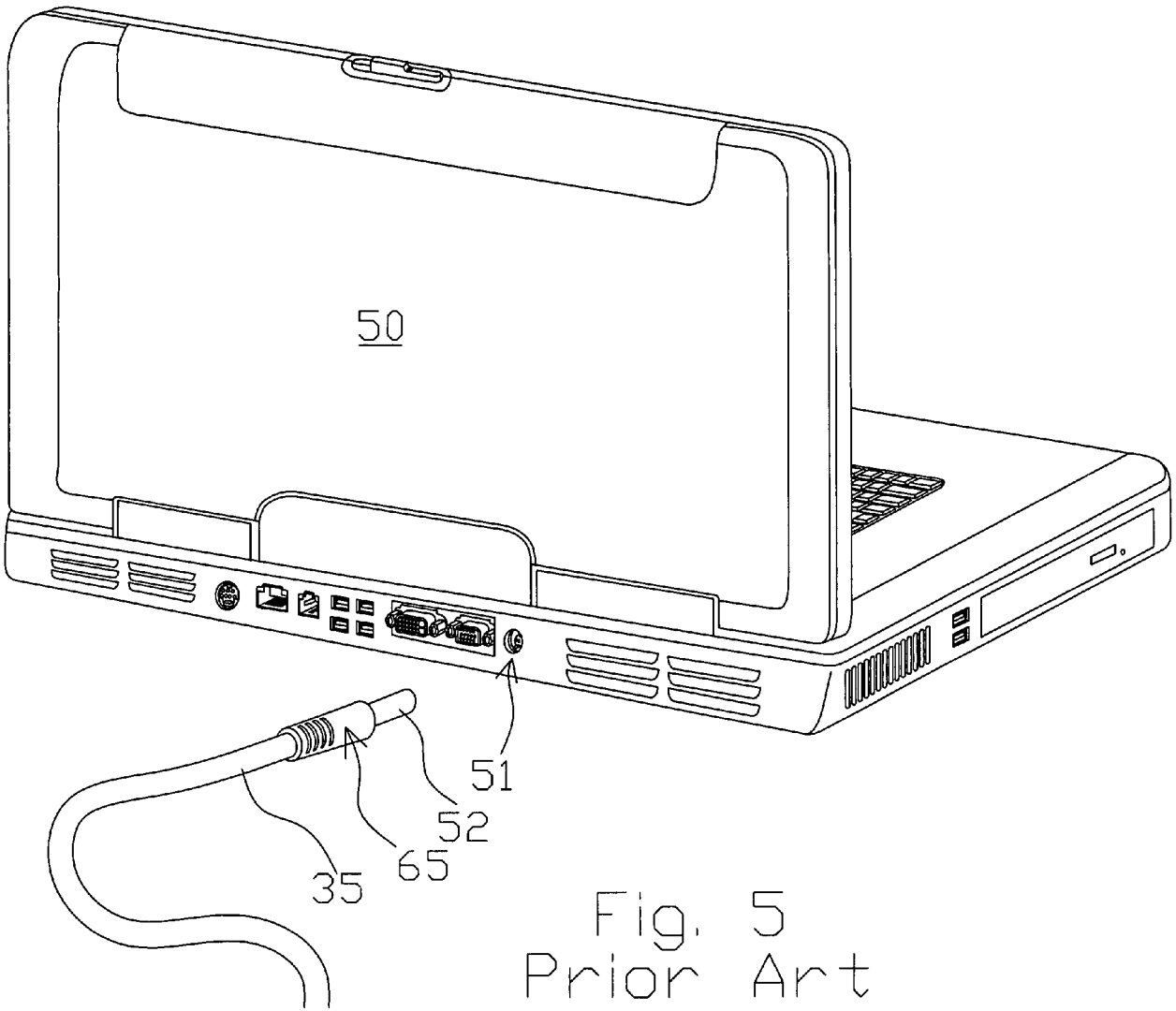
Fig. 5 Prior Art
FIG. 5 is a prior art view of the laptop computer and power supply cord.

Referring to the drawings, FIG. 5 shows a prior art laptop computer 50 and a laptop end 65 of a power supply cable 35. As can be recognized, the laptop computer includes a case 55 that comprises an opening 51 into which the laptop end 65 of the power supply cable 35 is inserted to recharge the batteries of the laptop or allow the laptop to run off of AC voltage.

Figure 4A:
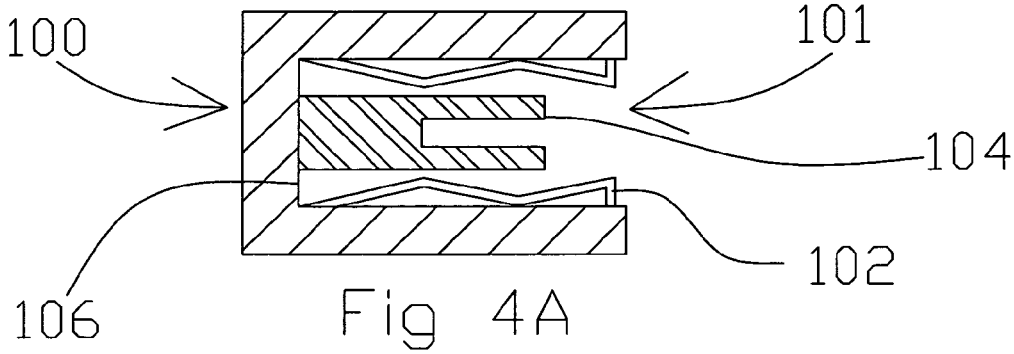
Fig 4A Prior Art
FIG. 4A shows a partial view of the prior art power supply board having a power supply receptacle and the associated parts. For ease in understanding the invention, the ground portion of the receptacle is represented as shown. In actual practice various types of ground connections may be present the power receptacle.
Figure 4B:
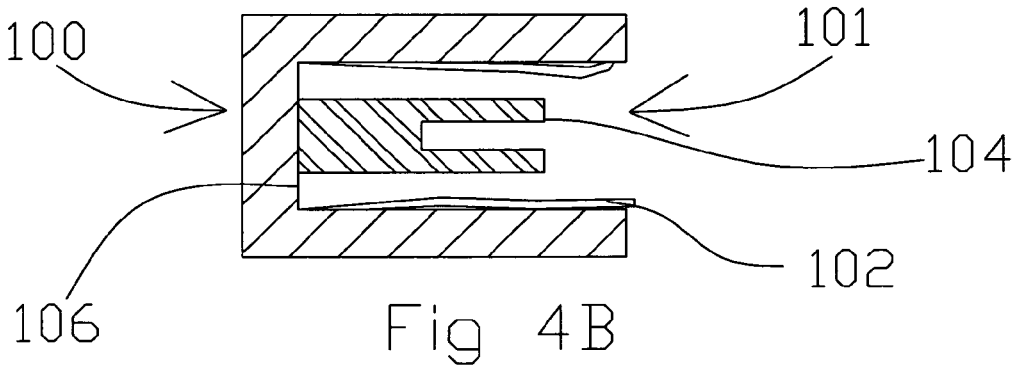
Fig 4B Prior Art
FIG. 4B shows the power supply receptacle that has been damaged or worn out.
Figure 4C:
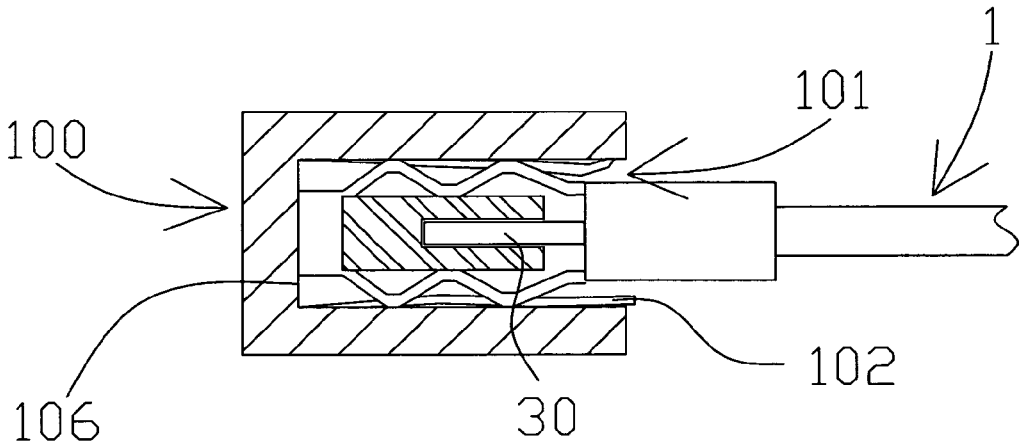
FIG. 4C shows the first embodiment in use in the broken power supply receptacle of FIG. 4B.

FIG. 1A shows a first embodiment of the invention which is a sacrificial power connector 1 that is inserted into the opening 51 and left in place. The connector 1 includes a first or receptacle end 3 that receives a ground barrel 52 arranged on the laptop end 65 of the power supply cord 35. The connector 1 includes a stabilizing tab 7 that includes adhesive 9 for securing the connector 1 in place by coupling it to the exterior of the laptop computer case 55. A second or insertion end 5 comprises a plurality of thin metal strips 10 which are fastened together via a circular end 13. These metal strips 10 define openings 14. Combined, the metal strips 10 and openings 14 form a barrel that serves the same operational purposes as barrel 52 when installed. Each of the thin metal strips 10 includes structurally weakened points 11 arranged along the length thereof. The overall length of end 5 is longer than the length of opening 101 defined by the sidewalls of receptacle 100 as shown in FIGS. 4A-4C. As can be understood, circular end 13 contacts a back wall 106 of receptacle 100 as the connector 1 is inserted into receptacle 100 causing the overall diameter of the end 5 to increase. That is, the thin metal strips 10 collapse or crumple at the weakened points 11 to cause them to bulge outward to contact the grounding members 102 as shown in FIG. 4C. This in turn establishes a ground plane for the laptop computer and serves to overcome the problem associated with bent or worn out grounding members 102. The centrally arranged pin 30, represented by broken lines in FIG. 1A is electrically connected to an internal receptacle arranged within end 3. The metal strips 10 connect to grounding members arranged within end 3. In this manner, an end of a power cable may be inserted into the end 3 and be electrically coupled to the end 5.

Figure 1B:
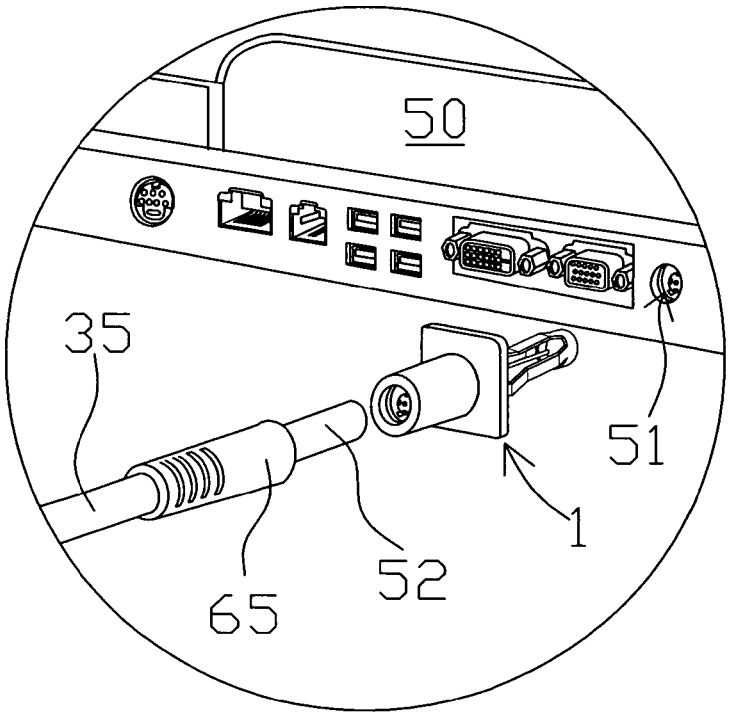
FIG. 1B is a perspective view of the first embodiment of the sacrificial laptop computer power connector prior to engagement between the second end of the power cord and the laptop computer.
Figure 1C:
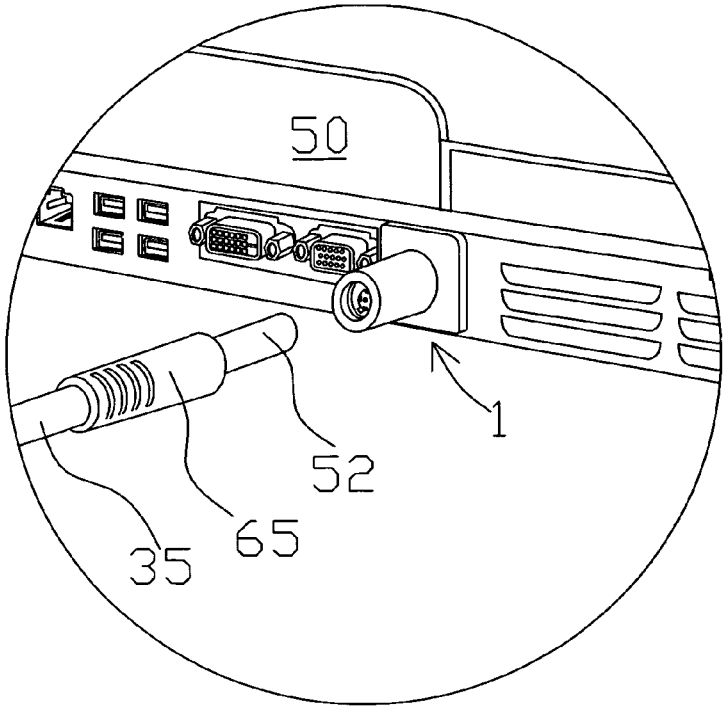
FIG. 1C is a perspective view of the sacrificial laptop computer power connector of FIG. 1B installed into the laptop computer.
Figure 1D:
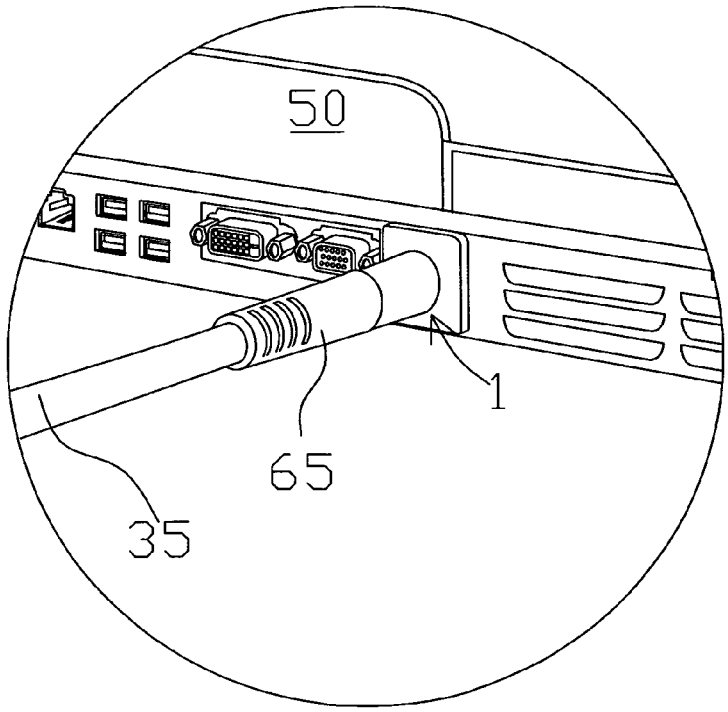
FIG. 1D is a perspective view of the sacrificial laptop computer installed into the laptop and having the power cord connected thereto.
Figure 2A:
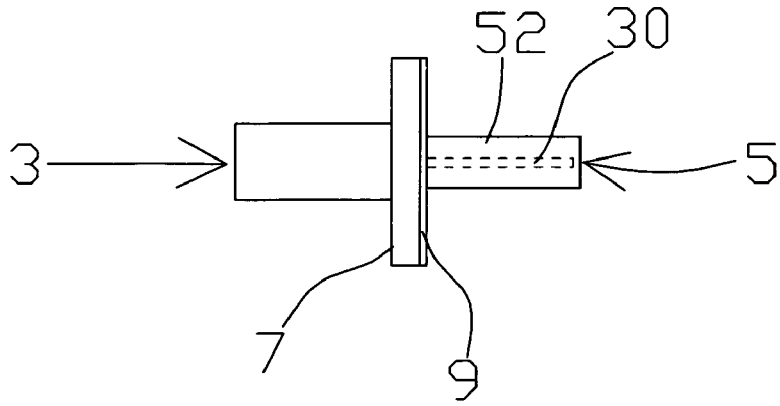
FIG. 2A is an enlarged perspective view of a variation of the first embodiment of a sacrificial laptop computer power connector taken from the side.
Figure 2B:
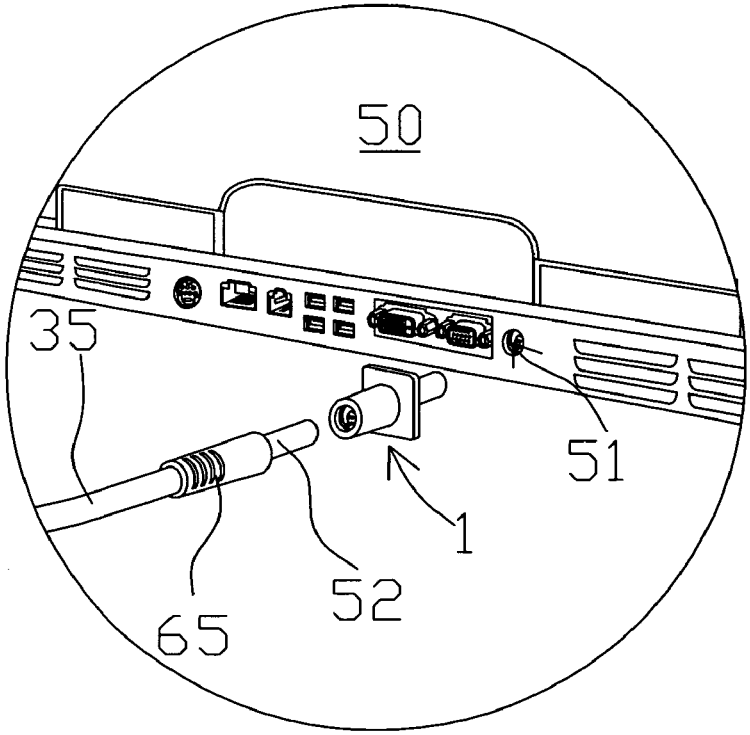
FIG. 2B is a perspective view of the sacrificial laptop computer power connector shown in FIG. 2A prior to engagement between the second end of the power cord and the laptop computer.
Figure 2C:
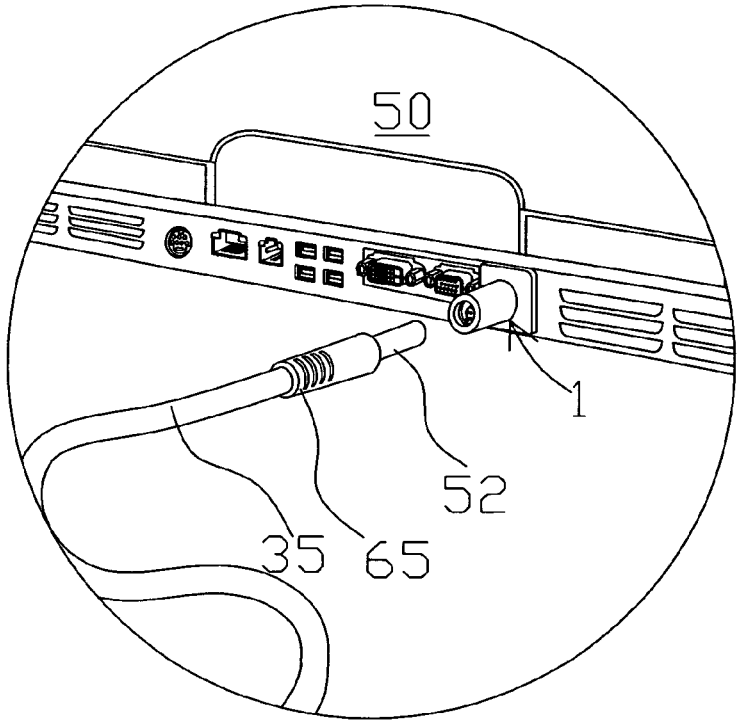
FIG. 2C is a perspective view of the sacrificial laptop computer power connector of FIG. 2B installed into the laptop computer.
Figure 2D:
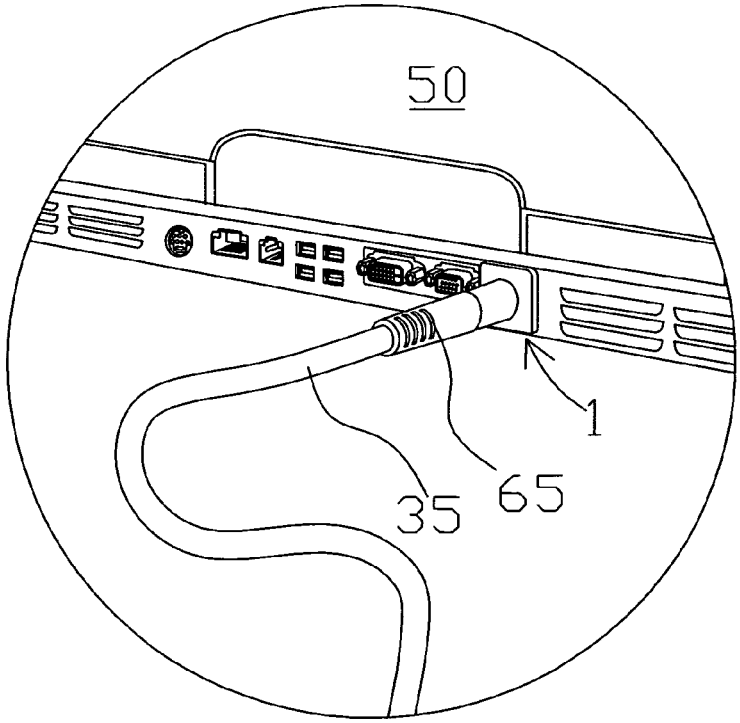
FIG. 2D is a perspective view of the sacrificial laptop computer installed into the laptop and having the power cord connected thereto.
Figure 3A:
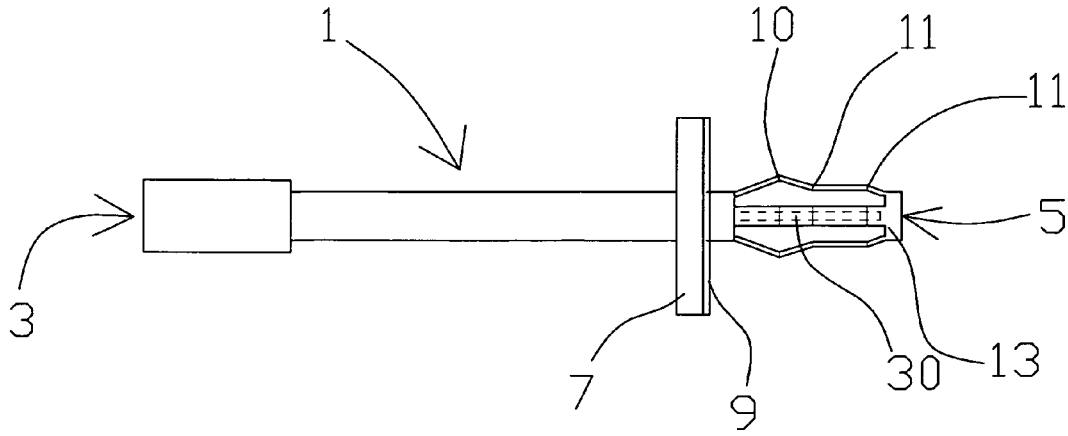
FIG. 3A is an enlarged perspective of a second embodiment sacrificial laptop computer power connector taken from the side.
Figure 3B:
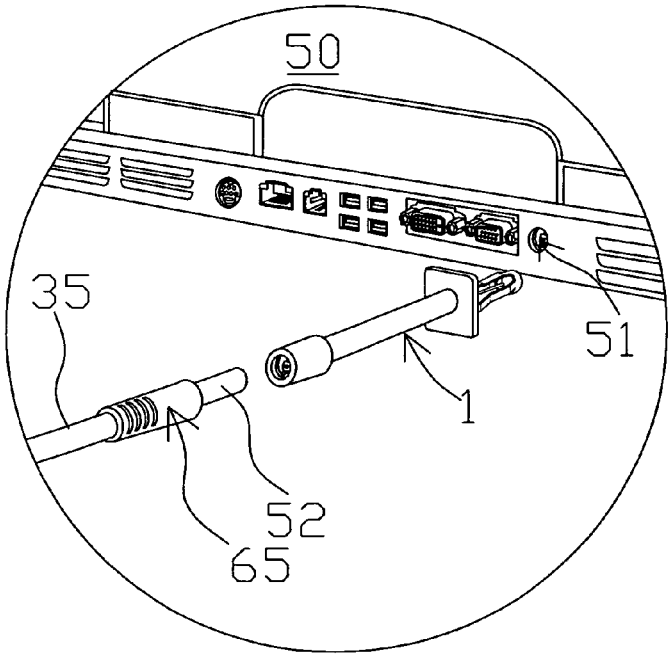
FIG. 3B is a perspective view of the second embodiment of the sacrificial laptop computer power connector prior to engagement between the second end of the power cord and the laptop computer.
Figure 3C:
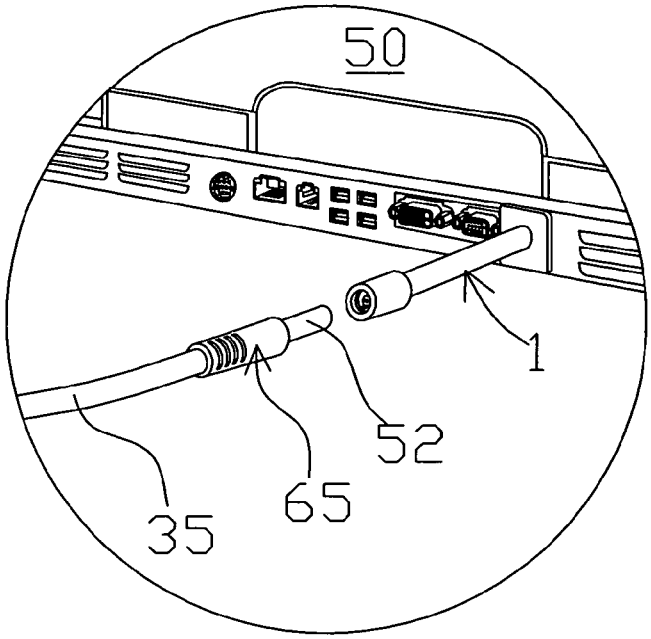
FIG. 3C is a perspective view of the sacrificial laptop computer power connector of FIG. 3B installed into the laptop computer.
Figure 3D:
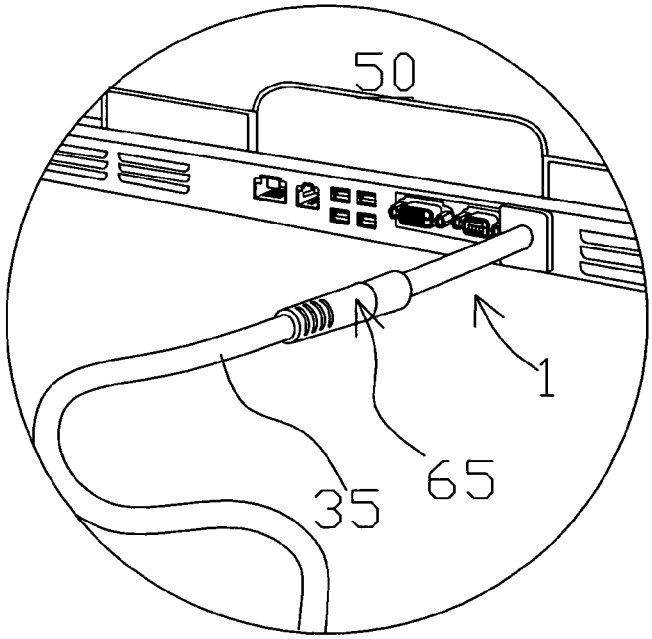
FIG. 3D is a perspective view of the sacrificial laptop computer installed into the laptop and having the power cord connected thereto.

As can be understood by viewing FIGS. 1B-1D, the operator inserts the connector 1 into the laptop receptacle 100. Thereafter, the sacrificial connector 1 is left in place and the laptop end 65 of the power cord 35 is inserted into end 3 of the connector 1. End 3 includes all of the elements of the receptacle 100 shown in FIG. 4A. When the ground strips of the sacrificial connector 1 become worn out, then the connector is simply removed and replace. In this manner, the need for expensive repairs is avoided. The metal strips 10 of connector 1 serve the same electrical purpose as the ground barrel 52 of the prior art connector.

FIGS. 2A-2D show a variation of the first embodiment of the invention. In this instance, the connector 1 comprises a receptacle end 3 and an insertion end 5. The receptacle end 3 includes those components shown in FIGS. 4A-4C of the prior art receptacle. The insertion end 5 includes a barrel 52 and a pin 30 represented by broken lines that acts in the same electrical manner as the power pin 30 shown in FIG. 4C. The sacrificial connector 1 is inserted into the power receptacle 100 when the operator first purchases the laptop computer 50 and remains there until such time as the ground strips or members become flattened. The sacrificial connector 1 is then removed and replaced with a new connector 1 to avoid costly repairs to the laptop. The connector 1 also includes a plastic tab 7 and adhesive 9 for securing the connector in place. The barrel 52 and pin 30 are arranged as discussed above with respect to FIGS. 1A-1D.

FIGS. 3A-3D show a second embodiment of the invention. In this instance, the connector 1 includes a receptacle end 3 and an insertion end 5 that are separated by a short cord or length of cable 70 that comprises the conductors (not shown) that electrically connect the end 3 to end 5. Insertion end 5 is similar to the end shown in FIGS. 1A-1D and operates in like manner. As can be understood by the drawings, this second embodiment comprises a short length of cable arranged between the ends 3, 5 of the connector 1. The connector 1 can be coupled to a power supply cord to transmit power to the laptop computer. Thus, the embodiment shown in FIGS. 3A-3D differs from the one shown in FIGS. 1A-1D only in the cable 70 includes a first flexible conductor that connects the power pin 30 to the receptacle in end 3 and a second flexible conductor that connects the thin strips 10 with the ground members that are arranged in end 3. The flexible conductors may be formed from wires that each includes an insulation to electrically isolate the ground from the power pin 30. These flexible conductors may be copper or aluminum stranded wire each having a diameter within size of a wire range of 16-22 AWG.

FIGS. 4A and 4B depict prior art power supply receptacles 100 that are typically arranged on a power supply board of a laptop computer. The receptacle 100 shown in FIG. 4A is in proper working order and includes an opening 101 into which an end of the power cord is inserted. The receptacle includes a pair of ground strips or members 102 that contact the barrel of the laptop plug end of the power supply cord to create a ground plane that allows current to flow into the laptop computer. A central power receptacle 104 includes an opening for receiving a pin that is arranged on the power supply cord.

As can be understood by FIG. 4B, the ground strips 102 tend to flatten out over time. This prevents them from coming into contact with the barrel of the plug end of the power supply cord which prevents the laptop from being grounded and thereby prevents current from flowing into the laptop for operating it and recharging the batteries. Current repair techniques require the removal and replacement of the receptacle 100 by de-soldering it from the power supply board. The invention aims to overcome this problem by providing a connector or combination cord/connector that includes a novel end that expands in diameter as it is inserted into a power receptacle of the laptop computer.

As can be understood by FIG. 4C, the connector ends of the first and second embodiments comprise thin strips of metal that are scored or formed such that they collapse or crumple to expand the diameter of the power connector when it is inserted into the power receptacle 100 to contact the flattened ground strips 102. In this manner, the ground is reestablished and the laptop can receive power.

While the invention has been described with respect to preferred embodiments, it is apparent to those skilled in the art that changes, modifications and additions may be made to the herein described embodiments without departing from the scope of the invention. Accordingly, it is intended that all matter contained in the above description or shown in the accompanying drawings shall be interpreted as illustrative and not in a limiting sense or use.

I claim:

1. A sacrificial connector comprising:

a male end having a power pin centrally arranged within a metallic barrel, said power pin providing a DC biased voltage, said metallic barrel maintained in a grounded state such that the DC biased voltage from the power pin can flow into a laptop computer having a power receptacle into which the male end of the sacrificial connector is inserted;

a female end having a larger diameter than the male end, said female end comprising at least one ground member that is electrically connected to the metallic barrel of the male end, said female end further including a receptacle that defines an opening having a diameter substantially equal to the metallic barrel of the male end, said receptacle being electrically connected to the power pin of the male end;

a tab having a first side near the male end and a second side near the female end, said tab comprising electrically insulating material being arranged on an exterior of the sacrificial connector and extending radially outward therefrom; and, a layer of adhesive arranged onto the first side of the tab, said layer of adhesive securing the sacrificial connector to an exterior surface of a case of a laptop computer that surrounds an opening into which an end of a power cord is inserted.

2. The sacrificial connector of claim 1 further comprising a length of power cord arranged between the first and second ends of the sacrificial connector and having two flexible wires that are insulated from one another, one of said flexible wires connecting the power pin of the male end to the receptacle of the female end, the other of said flexible wires connecting the metallic barrel of the male end to the grounding members arranged within the female end to make electrical contact therebetween.

3. The sacrificial connector of claim 1 wherein said metallic barrel comprises a plurality of metallic strips that define openings arranged therebetween, said metallic strips terminating in a circular end, an overall length of said metallic barrel being longer than a length of an opening defined by sidewalls of a power receptacle into which the male end of the sacrificial connector is inserted such that said circular end comes into contact with a back wall of the power receptacle causing an initial diameter of the male end to increase to a larger diameter and electrically connect the metallic strips to ground members within the power receptacle.

4. The sacrificial connector of claim 1 wherein said metallic barrel comprises thin metal strips that include weakened points which cause the metallic strips to bulge outward to contact grounding members of a power receptacle into which the sacrificial connector is connected to cause a diameter of the metallic barrel to increase when inserted into the power receptacle.

5. The sacrificial power connector of claim 1 wherein said metallic barrel is formed from a solid strip of cylindrical metal and surrounds the power pin.

6. A sacrificial connector comprising:

a male end having a power pin centrally arranged within a metallic barrel, said power pin providing a DC biased voltage, said metallic barrel maintained in a grounded state such that the DC biased voltage from the power pin can flow into a laptop computer having a power receptacle into which the male end of the sacrificial connector is inserted;

a female end having a larger diameter than the male end, said female end comprising at least one ground member that is electrically connected to the metallic barrel of the male end, said female end further including a receptacle that defines an opening having a diameter substantially equal to the metallic barrel of the male end, said receptacle being electrically connected to the power pin of the male end;

a tab having a first side near the male end and a second side near the female end, said tab comprising electrically insulating material being arranged on an exterior of the sacrificial connector and extending radially outward therefrom; and, a layer of adhesive arranged onto the first side of the tab, said layer of adhesive securing the sacrificial connector to an exterior surface of a case of a laptop computer that surrounds an opening into which an end of a power cord is inserted, wherein said metallic barrel comprises thin metal strips that include weakened points which cause the metallic strips to bulge outward to contact grounding members of a power receptacle into which the sacrificial connector is connected to cause a diameter of the metallic barrel to increase when inserted into the power receptacle.

7. The sacrificial connector of claim 6 further comprising a the length of power cord arranged between the first and second ends of the sacrificial connector and having two flexible wires that are insulated from one another, one of said flexible wires connecting the power pin of the male end to the receptacle of the female end, the other of said flexible wires connecting the metallic barrel of the male end to the grounding members arranged within the female end to make electrical contact therebetween.

8. The sacrificial connector of claim 6 wherein said metallic barrel comprises a plurality of metallic strips that define openings arranged therebetween, said metallic strips terminating in a circular end, an overall length of said metallic barrel being longer than a length of an opening defined by sidewalls of a power receptacle into which the male end of the sacrificial connector is inserted such that said circular end comes into contact with a back wall of the power receptacle causing an initial diameter of the male end to increase to a larger diameter and electrically connect the metallic strips to ground members within the power receptacle.

9. A combination power supply cord and sacrificial power connector, said power supply cord including a first end that includes plug that is inserted into a wall socket that provides a source of AC voltage, said plug connected to a converting device that converts the AC voltage into DC voltage, a second end of the power supply cord terminating in a sacrificial connector comprising:

a male end having a power pin centrally arranged within a metallic barrel, said power pin providing a DC biased voltage, said metallic barrel maintained in a grounded state such that the DC biased voltage from the power pin can flow into a laptop computer having a power receptacle into which the male end of the sacrificial connector is inserted;

a female end having a larger diameter than the male end, said female end comprising at least one ground member that is electrically connected to the metallic barrel of the male end, said female end further including a receptacle that defines an opening having a diameter substantially equal to the metallic barrel of the male end, said receptacle being electrically connected to the power pin of the male end;

a tab having a first side near the male end and a second side near the female end, said tab comprising electrically insulating material being arranged on an exterior of the sacrificial connector and extending radially outward therefrom; and, a layer of adhesive arranged onto the first side of the tab, said layer of adhesive securing the sacrificial connector to an exterior surface of a case of a laptop computer that surrounds an opening into which an end of a power cord is inserted.

10. The sacrificial connector of claim 9 further comprising a the length of power cord arranged between the first and second ends of the sacrificial connector and having two flexible wires that are insulated from one another, one of said flexible wires connecting the power pin of the male end to the receptacle of the female end, the other of said flexible wires connecting the metallic barrel of the male end to the grounding members arranged within the female end to make electrical contact therebetween.

11. The sacrificial connector of claim 9 wherein said metallic barrel comprises a plurality of metallic strips that define openings arranged therebetween, said metallic strips terminating in a circular end, an overall length of said metallic barrel being longer than a length of an opening defined by sidewalls of a power receptacle into which the male end of the sacrificial connector is inserted such that said circular end comes into contact with a back wall of the power receptacle causing an initial diameter of the male end to increase to a larger diameter and electrically connect the metallic strips to ground members within the power receptacle.

12. The sacrificial connector of claim 9 wherein said metallic barrel comprises thin metal strips that include weakened points which cause the metallic strips to bulge outward to contact grounding members of a power receptacle into which the sacrificial connector is connected to cause a diameter of the metallic barrel to increase when inserted into the power receptacle.

13. The sacrificial power connector of claim 9 wherein said metallic barrel is formed from a solid strip of cylindrical metal and surrounds the power pin.

* * * * *